US008175509B2

(12) United States Patent
Gon

(10) Patent No.: US 8,175,509 B2
(45) **Date of Patent: *May 8, 2012**

(54) IMAGE FORMING APPARATUS WITH FIXING UNIT HAVING MAGNETISM ADJUSTING CAPABILITIES

(75) Inventor: Syoukou Gon, Osaka (JP)

(73) Assignee: Kyocera Mita Corporation (JP)

( * ) Notice: Subject to any disclaimer, the term of this patent is extended or adjusted under 35 U.S.C. 154(b) by 418 days.

This patent is subject to a terminal disclaimer.

(21) Appl. No.: 12/504,178

(22) Filed: Jul. 16, 2009

(65) Prior Publication Data

US 2010/0014900 A1 Jan. 21, 2010

(30) Foreign Application Priority Data

Jul. 18, 2008 (JP) ..... 2008-187574

(51) Int. Cl.
*G03G 15/20* (2006.01)

(52) U.S. Cl. ..... 399/330; 399/320; 399/328; 399/329; 399/336

(58) Field of Classification Search ..... 399/320, 399/330, 335, 336, 329, 328
See application file for complete search history.

(56) References Cited

U.S. PATENT DOCUMENTS

| | | | | |
|---|---|---|---|---|
| RE36,962 | E | 11/2000 | Higashi et al. | |
| 6,415,128 | B1 * | 7/2002 | Takagi et al. | 399/335 |
| 6,577,839 | B2 * | 6/2003 | Samei | 399/328 |
| 7,268,327 | B2 | 9/2007 | Yamamoto et al. | |
| 2005/0191098 | A1 * | 9/2005 | Ueno et al. | 399/329 |
| 2007/0014599 | A1 * | 1/2007 | Yasuda et al. | 399/328 |
| 2007/0019063 | A1 | 1/2007 | Yasuda et al. | |

* cited by examiner

*Primary Examiner* — David Gray
*Assistant Examiner* — Francis Gray
(74) *Attorney, Agent, or Firm* — Gerald E. Hespos; Michael J. Porco

(57) ABSTRACT

A fixing unit of an image forming apparatus includes a magnetism adjusting unit switching the position of a shielding member between a shielding position where the shielding member is positioned inside the sheet-conveyed region to shield the pass of the magnetism and a retracted position where the shielding member is positioned outside the sheet-conveyed region to permit the pass of the magnetism. The shielding member is provided in a plural number in the axial direction of the movable core. The shielding members have a different length in the axial direction and a different width in a circumferential direction of the movable core, the length and the width corresponding to a plurality of sizes of the sheet in the width direction of the sheet. The magnetism adjusting unit switches each of the shielding members between the shielding position and the retracted position in accordance with the width-direction size of the sheet.

7 Claims, 11 Drawing Sheets

ROTATION ANGLE
360°
270°
180°
90°
0°
-90°
θ
α
β
60a
60b
60c
SHIELDING WIDTH (240-DEGREE PLATE)
SHIELDING WIDTH (160-DEGREE PLATE)
SHIELDING WIDTH (80-DEGREE PLATE)
PLATE FOR A3
PLATE FOR A4
PLATE FOR A5

ROTATION ANGLE
360°
270°
180°
90°
0°
-90°
θ
α
β
60a
60b
60c
SHIELDING WIDTH (240-DEGREE PLATE)
PLATE FOR A3
SHIELDING WIDTH (160-DEGREE PLATE)
PLATE FOR A4
SHIELDING WIDTH (80-DEGREE PLATE)
PLATE FOR A5

IMAGE FORMING APPARATUS WITH FIXING UNIT HAVING MAGNETISM ADJUSTING CAPABILITIES

BACKGROUND OF THE INVENTION

1. Field of the Invention

The present invention relates to an image forming apparatus including a fixing unit which fixes a heated and melted unfixed toner onto a sheet of paper carrying a toner image while passing the sheet of paper between a nip by a heated roller pair or a heating belt and a roller.

2. Description of the Related Art

In this type of image forming apparatus, in order to meet demands such as shortening the warm-up time of a fixing unit and saving energy, attention has recently been drawn to a belt method capable of operating with a smaller amount of heat capacity (e.g., Japanese Patent Laid-Open Publication No. 6-318001). In recent years, an electromagnetic induction heating method (IH) capable of rapid heating or efficient heating has also been notable, and taking into account saving energy when fixing a color image, a large number of products created by combining the electro-magnetic induction heating and belt methods have been put on the market. The combination of the belt method and the electro-magnetic induction heating has advantages in that a coil can be easily laid out and cooled as well as a belt directly heated. These and other advantages frequently prompt an electro-magnetic inductor to be arranged outside of a belt (so-called external IH).

In the electromagnetic induction heating method, various arts have been developed for the purpose of preventing an excessive temperature rise in a non-sheet-conveyed region in accordance with the width (conveyed-sheet width) of a sheet of paper conveyed through a fixing unit. Particularly, a means for switching the size of a sheet of paper in the external IH is described in the following prior arts (e.g., Japanese Patent Laid-Open Publication No. 2006-120523). In the prior art, a magnetic-flux shielding plate having a curved-surface shape is formed in advance with a plurality of steps in the longitudinal directions thereof, and these steps form an area for passing magnetism and an area screening out magnetism in the width directions of a sheet of paper. Therefore, when the size of a sheet of paper is changed, the magnetic-flux shielding plate is rotated in accordance with the conveyed-sheet width, thereby screening out magnetism in a non-sheet-conveyed region to prevent a heated roller or the like from raising the temperature therein excessively.

However, in the prior art (Japanese Patent Laid-Open Publication No. 2006-120523), the positions of the steps formed beforehand in the shielding plate determine the shielding area and the non-shielding area, thereby making it difficult to handle sheets of paper having diverse sizes. Specifically, the prior art is capable of relatively easily handling one or two kinds of sheets having small sizes, but incapable of handling three or more kinds of sheets having small widths without devising the size of the magnetic-flux shielding plate or control of the rotation angle thereof.

In addition, if the steps are formed in the directions where the shielding plate rotates in the prior art (Japanese Patent Laid-Open Publication No. 2006-120523), then the rotation angle as a whole is restricted to hinder enlarging each step (e.g., a rotation angle of approximately 15°-30°), thereby reducing the quantity of screened-out magnetism and making it impossible to suppress the generated-heat quantity sufficiently.

SUMMARY OF THE INVENTION

It is an object of the present invention to provide an image forming apparatus capable of regulating magnetism for more paper sizes and producing an effect great enough at a shielding time.

In order to accomplish the object, an image forming apparatus according to the present invention includes an image forming section forming a toner image and transferring the toner image onto a sheet and a fixing unit including a heating member and a pressing member, and fixing the toner image onto the sheet while nipping and conveying the sheet between the heating member and the pressing member. The heating member has a sheet-conveyed region that the sheet passes. The fixing unit further includes a coil arranged along an outer surface of the heating member and generating a magnetic field, a fixed core arranged opposite to the heating member with respect to the coil and forming a magnetic path, a cylindrical movable core so arranged between the fixed core and the heating member with respect to a direction in which the coil generates the magnetic field, as to form the magnetic path together with the fixed core, the cylindrical movable core having an axis extending in a width direction of the sheet being conveyed, a shielding member arranged on an outer peripheral surface of the movable core and shielding the magnetism in the magnetic path, and a magnetism adjusting unit rotating the movable core about the axis to switch the position of the shielding member between a shielding position where the shielding member is positioned inside the sheet-conveyed region to shield the pass of the magnetism and a retracted position where the shielding member is positioned outside the sheet-conveyed region to permit the pass of the magnetism. The shielding member is provided in a plural number in the axial direction of the movable core, the shielding members having a different length in the axial direction and a different width in a circumferential direction of the movable core, the length and the width corresponding to a plurality of sizes of the sheet in the width direction of the sheet. The magnetism adjusting unit switches each of the shielding members between the shielding position and the retracted position in accordance with the width-direction size of the sheet.

These and other objects, features and advantages of the present invention will become more apparent upon reading of the following detailed description along with the accompanied drawings.

BRIEF DESCRIPTION OF THE DRAWINGS

FIGS. 4A to 4G show first to third shielding members arranged in the axial directions of the center core and the lengths and circumferential-direction widths thereof.

DETAILED DESCRIPTION OF THE PREFERRED EMBODIMENTS

Embodiments of the present invention will be below described in detail with reference to the drawings.

Figure 1:
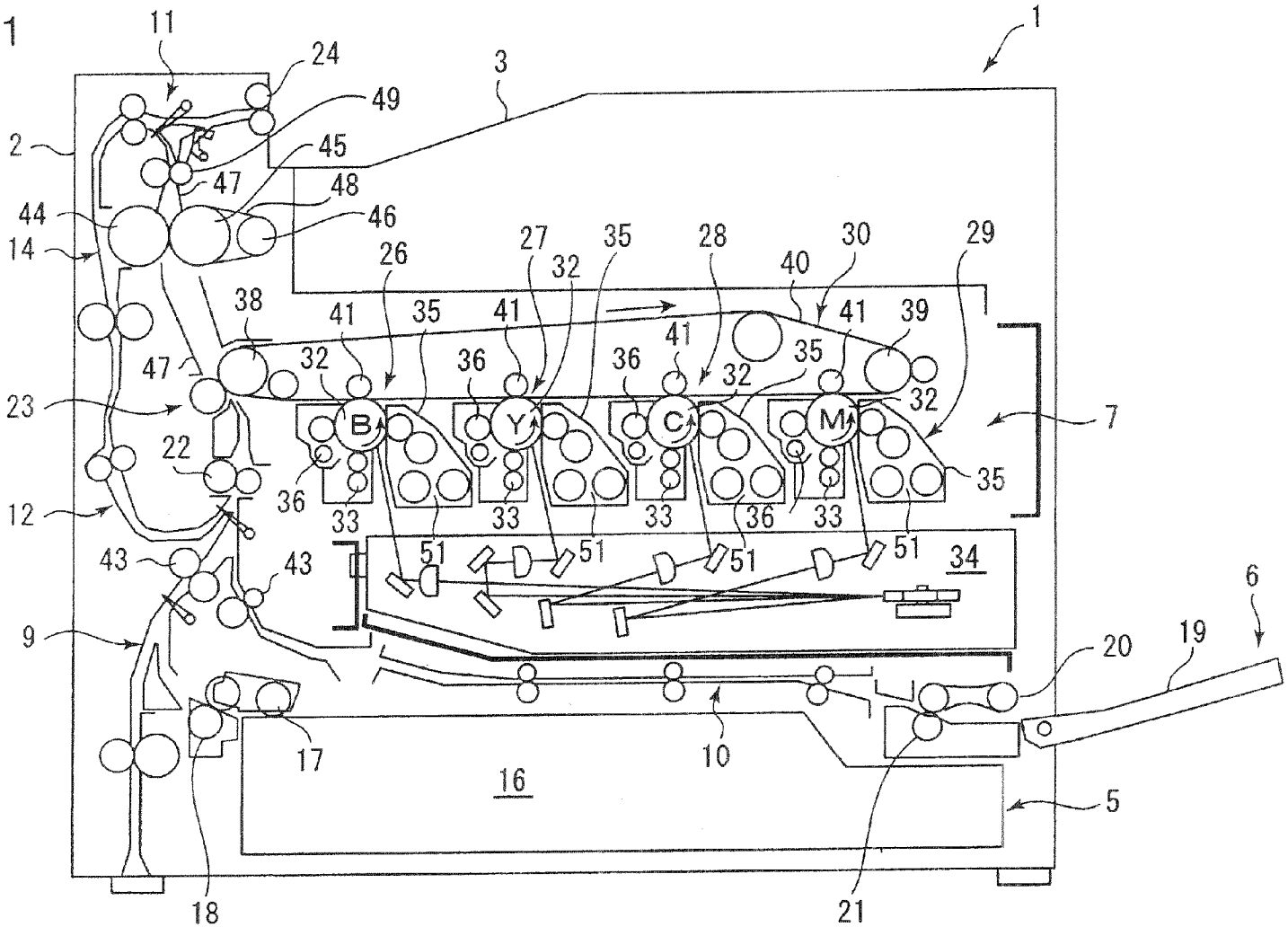
FIG. 1 is a schematic view showing a configuration of an image forming apparatus according to an embodiment of the present invention.

FIG. 1 is a schematic view showing a configuration of an image forming apparatus 1 according to an embodiment of the present invention. The image forming apparatus 1 takes the form of a printer, a copying machine, a facsimile device, a complex machine having some of the functions thereof or the like which conducts printing by transferring a toner image onto a surface of a printing medium such as printing paper on the basis of image information, for example, inputted from the outside.

The image forming apparatus 1 of FIG. 1 is, for example, a tandem-type color printer and includes an apparatus body 2 shaped like a rectangular-parallelepiped box which forms (prints) a color image on a sheet of paper inside thereof. The apparatus body 2 is provided on the top with a paper discharge portion (discharge tray) 3 discharging a sheet of paper after a color image is printed thereon.

The apparatus body 2 houses a paper feed cassette 5 storing sheets of paper in a lower part thereof and is provided at the middle with a stack tray 6 for feeding a sheet of paper manually. In an upper part thereof, the apparatus body 2 houses an image forming section 7 forming an image on a sheet of paper based upon image data such as characters and pictures transmitted from outside of the apparatus.

On the left side of FIG. 1, the apparatus body 2 is formed with a first forwarding path 9 forwarding, to the image forming section 7, a sheet of paper delivered from the paper feed cassette 5 and is also formed from the right side to the left side with a second forwarding path 10 forwarding a sheet of paper delivered from the stack tray 6 to the image forming section 7. The apparatus body 2 is provided in the upper-left part with a fixing unit 14 which gives fixing to a sheet of paper after an image is formed thereon in the image forming section 7, and a third forwarding path 11 forwarding a sheet of paper subjected to fixing to the paper discharge portion 3.

The paper feed cassette 5 can be drawn out of the apparatus body 2 (e.g., forward from the paper surface of FIG. 1) and refilled with sheets of paper, and includes a storage portion 16 selectively storing at least two kinds of sheets having different sizes in the paper-feed directions. Sheets of paper stored in the storage portion 16 are delivered one by one toward the first forwarding path 9 by a paper feed roller 17 and a handling roller 18.

The stack tray 6 can be opened and closed on the exterior of the apparatus body 2 and includes a manual feed portion 19 for placing one or a plurality of sheets of paper to be fed by hand. Sheets of paper placed on the manual feed portion 19 are delivered one by one toward the second forwarding path 10 by a pick-up roller 20 and a handling roller 21.

The first forwarding path 9 and the second forwarding path 10 join in front of a resist roller 22. A sheet of paper supplied to the resist roller 22 waits once here, is sent out toward a secondary transfer portion 23 after undergoing a skew adjustment and a timing adjustment, and is given a secondary transfer of a full-color toner image on an intermediate transfer belt 40 in the secondary transfer portion 23. Thereafter, the sheet of paper subjected to toner-image fixing in the fixing unit 14 is turned over, if necessary, in a fourth forwarding path 12, and next, the reverse side undergoes a secondary transfer of the full-color toner image in the secondary transfer portion 23. After undergoing the toner-image fixing on the reverse side in the fixing unit 14, the sheet of paper passes through the third forwarding path 11 and is discharged to the paper discharge portion 3 by a discharge roller 24.

The image forming section 7 includes four image formation units 26 to 29 forming each toner image of black (B), yellow (Y), cyan (C) and magenta (M), as well as an intermediate transfer portion 30 synthesizing and carrying toner images of each color formed by the image formation units 26 to 29.

Each image formation unit 26 to 29 includes a photosensitive drum 32, a charging portion 33 facing the peripheral surface of the photosensitive drum 32, a laser scanning unit 34 arranged downstream from the charging portion 33 and applying a laser beam to a specified position on the peripheral surface of the photosensitive drum 32, a development portion 35 arranged downstream from a laser-beam irradiation position of the laser scanning unit 34 and facing the peripheral surface of the photosensitive drum 32, and a cleaning portion 36 arranged downstream from the development portion 35 and facing the peripheral surface of the photosensitive drum 32.

The photosensitive drum 32 of each image formation unit 26 to 29 is counterclockwise rotated in the figure by a drive motor (not shown) and the development portion 35 of each image formation unit 26 to 29 stores a black toner, a yellow toner, a cyan toner and a magenta toner, respectively, in a toner box 51 corresponding thereto.

The intermediate transfer portion 30 includes a driving roller 38 near the image formation unit 26, a driven roller 39 near the image formation unit 29, the intermediate transfer belt 40 stretched between the driving roller 38 and the driven roller 39, and four transfer rollers 41 each arranged downstream from the development portion 35 in the photosensitive drum 32 of each image formation unit 26 to 29 in such a way that they can be pressed via the intermediate transfer belt 40 into contact therewith.

In the intermediate transfer portion 30, toner images of each different color are superimposed and transferred at the positions of the transfer rollers 41 of each image formation unit 26 to 29 onto the intermediate transfer belt 40 and finally form a full-color toner image.

The first forwarding path 9 forwards a sheet of paper delivered from the paper feed cassette 5 to the intermediate transfer portion 30 and includes a plurality of forwarding rollers 43 arranged in predetermined positions inside of the apparatus body 2, and the resist roller 22 arranged in front of the intermediate transfer portion 30 and adjusting the timing of an image forming operation and a paper feeding operation by the image forming section 7.

The fixing unit 14 heats and pressurizes a sheet of paper after a toner image is formed thereon in the image forming section 7 to thereby fix an unfixed toner image on the sheet of paper and includes, for example, a roller pair made up of a heating pressing roller 44 and a fixing roller 45. Further, a heat roller 46 is arranged adjacent to the fixing roller 45, and a heating belt 48 is stretched between the heat roller 46 and the fixing roller 45. A specific structure of the fixing unit 14 will be further described later.

A forwarding path 47 is formed on each of the upstream and downstream sides of the fixing unit 14 in the paper forwarding direction. Through the upstream forwarding path 47, a sheet of paper forwarded through the intermediate transfer portion 30 is introduced into the nip between the pressing roller 44 and the fixing roller 45, passes between the pressing roller 44 and the fixing roller 45 and is guided to the third forwarding path 11 via the downstream forwarding path 47.

The third forwarding path 11 forwards a sheet of paper subjected to fixing in the fixing unit 14 to the paper discharge portion 3 and for this purpose, is provided at a proper position with a forwarding roller 49 and at the outlet with the discharge roller 24.

[Details of Fixing Unit]

Next, the fixing unit 14 of the image forming apparatus 1 according to this embodiment will be described in detail.

Figure 2:
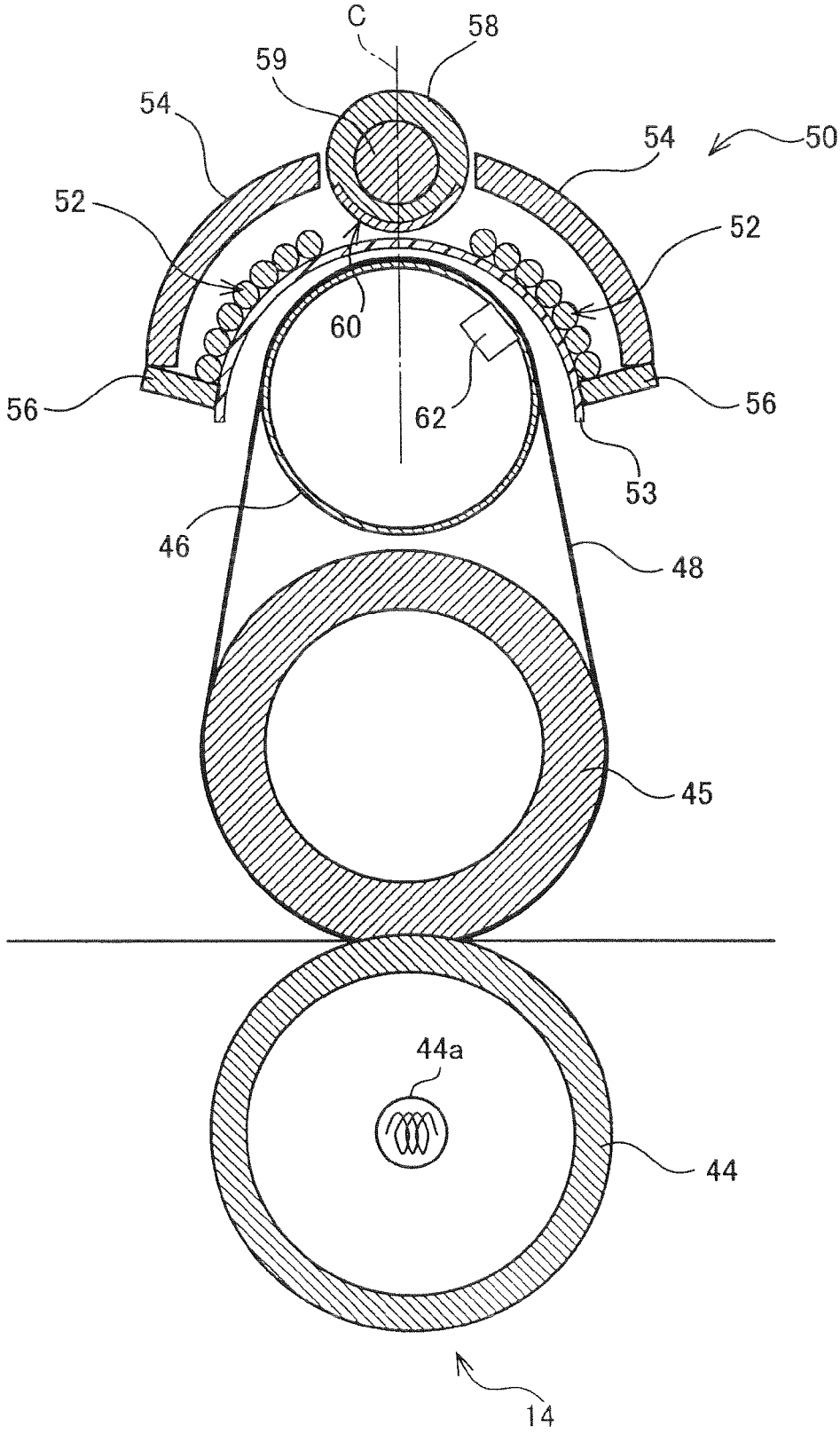
FIG. 2 is a longitudinal sectional view showing a structure example of a fixing unit.

FIG. 2 is a longitudinal sectional view showing a structure example of the fixing unit 14. In FIG. 2, it is shown with turned counterclockwise by approximately 90 degrees from a state thereof mounted in the image forming apparatus 1, and hence, the paper forwarding direction from below to above in FIG. 1 is from right to left in FIG. 2. If the apparatus body 2 is relatively large (complex machine or the like), the fixing unit 14 can be mounted in the direction given in FIG. 2, and in addition to the above, the fixing unit 14 may be arranged with inclined laterally from the state of FIG. 2.

As described above, the fixing unit 14 includes the pressing roller 44, the fixing roller 45, the heat roller 46 and the heating belt 48. Among them, the heating belt 48 includes a substrate made of a ferromagnetic material (e.g., Ni electroformed substrate) having a thickness of approximately 30 to 50 μm, a thin-film elastic layer (e.g., silicone rubber) formed in the surface layer thereof and having a thickness of approximately 200 to 500 μm, and a mold-release layer (e.g., PFA) further formed in the outer surface thereof. The heating belt 48 may be a resin belt such as PI if having no heat-generation function.

The heat roller 46 includes a core bar made of magnetic metal (e.g., Fe) having a diameter of approximately 30 mm and a thickness of approximately 0.2 to 1.0 mm and a mold-release layer (e.g., PFA) formed in the surface thereof.

The sheet pf paper having the toner image transferred thereon is nipped and conveyed between the pressing roller 44 and the heating belt 48. At this time, the sheet pf paper receives heat from the heating belt 48 and the toner image is fixed on the sheet of paper. The heating belt 48 has a sheet-conveyed region so set thereon that the sheet of paper of maximum size conveyable to the fixing unit 14 is brought into contact with the sheet-conveyed region.

The fixing roller 45 includes a core bar made of metal (e.g., SUS) and having a diameter of approximately 45 mm and a silicone-rubber sponge layer (e.g., PFA) formed thereon and having a thickness of approximately 5 to 10 mm. The pressing roller 44 includes a core bar made of metal (e.g., SUS) and having a diameter of approximately 50 mm, an Si rubber layer formed thereon and having a thickness of approximately 2 to 5 mm, and a mold-release layer (e.g., PFA) further formed on the surface thereof. Hence, a flat nip is formed between the heating belt 48, and the fixing roller 45 and the pressing roller 44. The pressing roller 44 may be provided inside with, for example, a halogen heater 44*a*, and the fixing roller 45 can be provided inside with a halogen heater (not shown).

The fixing unit 14 further includes an IH coil unit 50 (not shown in FIG. 1) arranged outward from the heat roller 46 and the heating belt 48. The IH coil unit 50 is formed by an induction heating coil 52, a pair of arch cores 54, a pair of side cores 56 and a center core 58.

[Coil]

Figure 3:
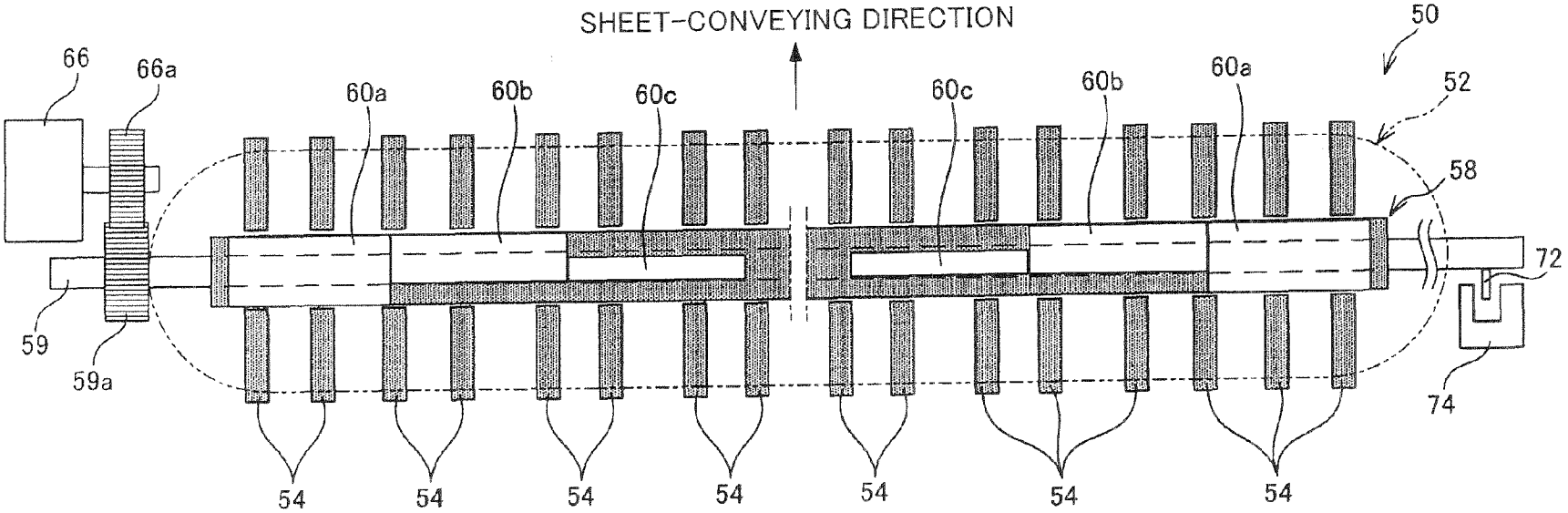
FIG. 3 is a plan view showing in detail a configuration of a center core.

In the example of FIG. 2, induction heating is conducted in the arc-shape part of the heat roller 46 and the heating belt 48 over substantially the full width of the heating belt 48, and thereby, the induction heating coil 52 is arranged on a virtual arc surface along the arc-shape outer surface. In practice, outward from the heat roller 46 and the heating belt 48, for example, a resinous bobbin 53 is arranged along the arc-shape outer surface, and the induction heating coil 52 is arranged in a winding shape on the bobbin 53 and has an elliptic shape in plan view (FIG. 3). Further, the induction heating coil 52 is formed around a winding center C in the cross section of FIG. 2. The bobbin 53 is molded into a semi-cylindrical shape along the outer surface of the heat roller 46, and the material thereof may preferably be a heat-resistant resin (e.g., PPS, PET or LCP).

[Fixed Core]

As can be seen in FIG. 2, the center core 58 is in the middle, and on both sides thereof, the arch cores 54 and the side cores 56 each form a pair. The arch cores 54 on both sides are ferrite cores (fixed core) which are symmetrical and molded in an arch-shape in section, and each full length thereof is greater than the length of the winding region of the induction heating coil 52. The side cores 56 on both sides are ferrite cores (fixed core) molded in a block-shape, and the side cores 56 on both sides are each connected to an end (lower end in FIG. 2) of the corresponding arch core 54 and cover the outside of the winding region of the induction heating coil 52.

The arch cores 54 are arranged, for example, apart from each other in a plurality of places in the longitudinal directions of the heat roller 46, and in this embodiment, each have a width of approximately 10 mm. The more densely the arch cores 54 are arranged, the better they induces a magnetic field. However, the induction capability does not deteriorate much even if the density lowers to a certain degree, and hence, preferably, the arrangement density may be set within a range where a sufficient capability can be obtained, taking the costs into account. Further, the distribution of temperature in the heating belt 48 can be regulated by adjusting the arrangement density of the arch cores 54. In this embodiment, for example, the arrangement density of the arch cores 54 is set to approximately ½ to ⅓ as a whole and is also set higher at both ends of the induction heating coil 52 than around the middle thereof, thereby preventing a fall in the temperature of the end region.

The side cores 56 each have a length of approximately 30 to 60 mm. A plurality of the side cores 56 are arranged continuously with no space in the longitudinal directions of the heat roller 46 and have a full length corresponding to the length of the winding region of the induction heating coil 52. In this way, the plurality of side cores 56 are continuously arranged, thereby reducing the temperature-distribution deflection caused by the arrangement of the arch cores 54. The arrangement of each core 54, 56 is determined, for example, in accordance with the distribution of a magnetic-flux density (magnetic-field strength) of the induction heating coil 52. Although the arch cores 54 are arranged at certain intervals, in places where they are not arranged, the side cores 56 compensate for a magnetic-focusing effect to thereby unify the magnetic-flux density distribution (temperature difference) in the longitudinal directions.

Outward from the arch cores 54 and the side cores 56, for example, a resinous core holder (not shown) is provided which supports the arch cores 54 and the side cores 56 and the material thereof may preferably be a heat-resistant resin (e.g., PPS, PET or LCP).

In the example of FIG. 2, the heat roller 46 is provided inside with a thermistor 62 which can be arranged especially in a place where the heat roller 46 generates a large quantity of heat from induction heating. Besides, a thermistor (not shown) can be provided inside of the heat roller 46, thereby improving the safety at the time of an abnormal temperature rise.

[Movable Core]

The center core 58 is, for example, a ferrite core having an outer diameter of approximately 14 to 20 mm and a cylinder-shape in section and includes a shaft member 59 inserted through the center thereof in the axial directions. The shaft member 59 is molded, for example, out of a non-magnetic metal (SUS or the like) or a heat-resistant resin (PPS, PET, LCP or the like). If the center core 58 is difficult to mold integrally, it may be formed by connecting a plurality of individual cylindrical blocks in the axial directions.

[Shielding Member]

The center core 58 has a shielding member 60 attached to the outer surface thereof. The shielding member 60 is a sheet member and has a whole shape curved like an arc. The shielding member 60 may be, as shown in the figure, for example, embedded in a thickness part of the center core 58, or affixed to the outer surface of the center core 58. The shielding member 60 can be affixed, for example, with a silicon adhesive.

It is preferable that the shielding member 60 is made of a non-magnetic and electrically-conductive material, such as oxygen-free copper. In the shielding member 60, a magnetic field perpendicular to the surface thereof penetrates to cause an induced current and thereby generate a reverse magnetic field and cancel an interlacing magnetic flux (perpendicular penetration magnetic field), thereby screening out the magnetic field. Further, an electrically-conductive member is employed, thereby suppressing Joule heat generation caused by an induced current to screen out the magnetic field efficiently. In order to improve the electrical conductivity, for example, it is effective to (1) select a material having a low specific resistance, (2) thicken the member, and take another measure, and specifically, the thickness of the shielding member 60 may preferably be 0.5 mm or above, and for example, it is 1 mm in this embodiment.

As shown in FIG. 2, if the shielding member 60 is in a position (shielding position) adjacent to the surface of the heating belt 48, the magnetic resistance rises around the induction heating coil 52 to lower the magnetic-field strength. On the other hand, if the center core 58 rotates (the direction is not especially limited) by 180 degrees from the state of FIG. 2 and thereby the shielding member 60 moves to the position (retracted position) farthest away from the heating belt 48, the magnetic resistance falls around the induction heating coil 52 to form a magnetic path through the arch cores 54 and the heat roller 46 on both sides around the center core 58, so that the magnetic field works on the heating belt 48 or the heat roller 46.

[Details of Center Core]

FIG. 3 is a plan view showing in detail a configuration of the center core 58. The center core 58 extends in the width directions of a sheet of paper orthogonal to the sheet-conveying direction (shown by an arrow of FIG. 3) and has a full length slightly greater than a maximum conveyed-sheet width (e.g., the longitudinal length of A3 or the lateral length of A4).

The IH coil unit 50 is provided with a stepping motor 66 whose mechanical power rotates the shaft member 59. A driven gear 59*a* is attached to an end part of the shaft member 59 and engaged with an output gear 66*a* of the stepping motor 66. As the stepping motor 66 is driven, the mechanical power rotates the shaft member 59, thereby rotating the center core 58. The stepping motor 66 constitutes a magnetism adjusting unit.

At this time, in order to detect a rotation angle (rotation displacement from a reference position) of the center core 58, the shaft member 59 is provided at an end thereof with an index 72 and a photo-interrupter 174 combined therewith. The index 72 is set to the reference position in the rotation angle of the center core 58 and shows a reaction (e.g., light shielding) at the reference position to the photo-interrupter 174. The rotation angle of the center core 58 can be controlled, for example, with a drive-pulse number applied to the stepping motor 66, and the stepping motor 66 has a control circuit (not shown) attached for this purpose. The control circuit can be formed, for example, by a control IC, an I/O driver, a semiconductor memory and the like. A detection signal from the photo-interrupter 74 is inputted via the input driver in the control IC, and on the basis of the detection signal, the control IC can detect the reference position of the center core 58. On the other hand, the control IC is notified of information on a present sheet size from an image-formation control portion (not shown). Upon receiving the information, the control IC reads information on the rotation angle (to the reference position as zero degrees) suitable for the sheet size from the semiconductor memory (ROM) and outputs, at a specified cycle, a drive pulse for reaching the targeted rotation angle. The drive pulse is applied to the stepping motor 66 via the output driver to operate the stepping motor 66. How to regulate the rotation angle of the center core 58 in accordance with a variety of paper sizes will be further described later.

In the example of FIG. 3, as the above shielding member (reference numeral 60 in FIG. 2), three kinds of first shielding member 60*a*, second shielding member 60*b* and third shielding member 60*c* are separately arranged in the axial directions (longitudinal directions) of the center core 58. The first shielding member 60*a*, second shielding member 60*b* and third shielding member 60*c* are different from each other in arrangement and length in the axial directions of the center core 58 and likewise in length (width for covering the center core 58) in the circumferential directions of the center core 58, which will be below described.

FIG. 4A to 4G show the first to third shielding members 60*a* to 60*c* arranged in the axial directions of the center core and the lengths and circumferential-direction widths thereof.

Figure 4A:
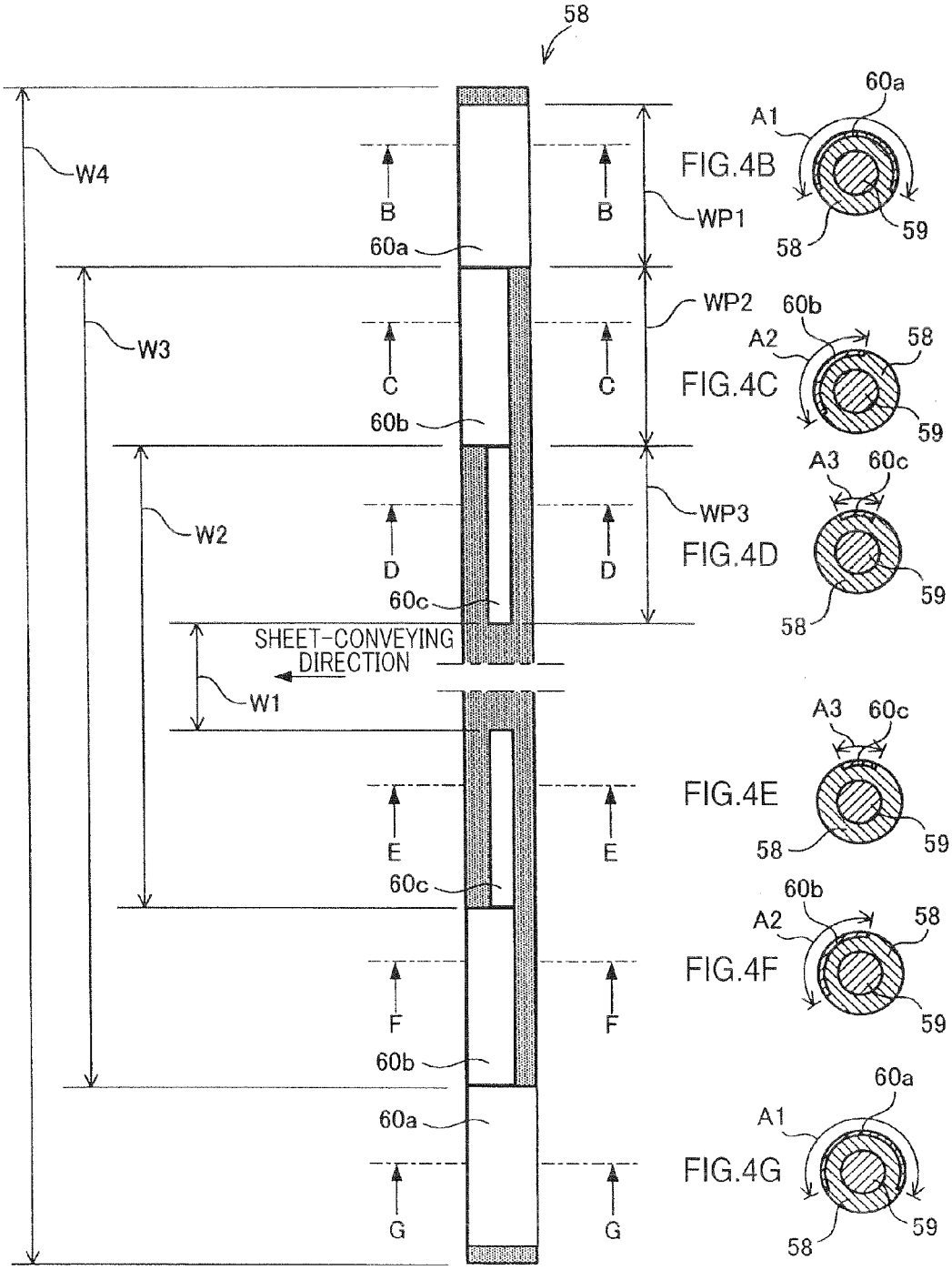

As shown in FIG. 4A, the three kinds of shielding members 60*a* to 60*c* are symmetrical in the axial directions of the center core 58. The first shielding member 60*a* is near both ends of the center core 58, and toward the middle from there, the second shielding member 60*b* and the third shielding member 60*c* are arranged in this order. The innermost third shielding member 60*c* (near the middle) is outside of a sheet-conveyed region W1 corresponding to a minimum paper size, the second shielding member 60*b* is outside of a sheet-conveyed region W2 corresponding to an intermediate paper size and the first shielding member 60*a* is outside of a sheet-conveyed region W3 one size larger than this. This arrangement makes it possible to handle four types of sheets in total having, for example, a maximum paper size of 13 inches (330 mm) and three smaller paper sizes—A3 (297 mm), A4 length (210 mm) and A5 length (149 mm). Each shielding member 60*a*,

60*b*, 60*c* has a length of WP1, WP2, WP3 in the axial directions, respectively, according to the corresponding paper size.

In this embodiment, the boundary between each shielding member 60*a*, 60*b*, 60*c* is practically designed to cut (enter) inward by approximately 10±5 mm into each sheet-conveyed region W1, W2, W3. Since the temperature of anon-sheet-conveyed region usually becomes higher than the temperature of a sheet-conveyed region, in consideration of heat transfer from the non-sheet-conveyed region, cutting each shielding member 60*a*, 60*b*, 60*c* to the above degree into each sheet-conveyed region W1, W2, W3 is useful for keeping the temperature distribution around the boundary in balance.

[Circumferential-Direction Width of Shielding Member]

In the case of the above four types of paper sizes, as shown in FIGS. 4B and 4G, the first shielding member 60*a* has a center angle A1 of 240 degrees around the center of the center core 58 as the width in the circumferential directions, the second shielding member 60*b* has, as shown in FIGS. 4C and 4F, a center angle A2 of 160 degrees as the circumferential-direction width, and the third shielding member 60*c* has, as shown in FIGS. 4D and 4E, a center angle A3 of 80 degrees as the circumferential-direction width.

[Magnetism Adjusting Unit]

Figure 5B:
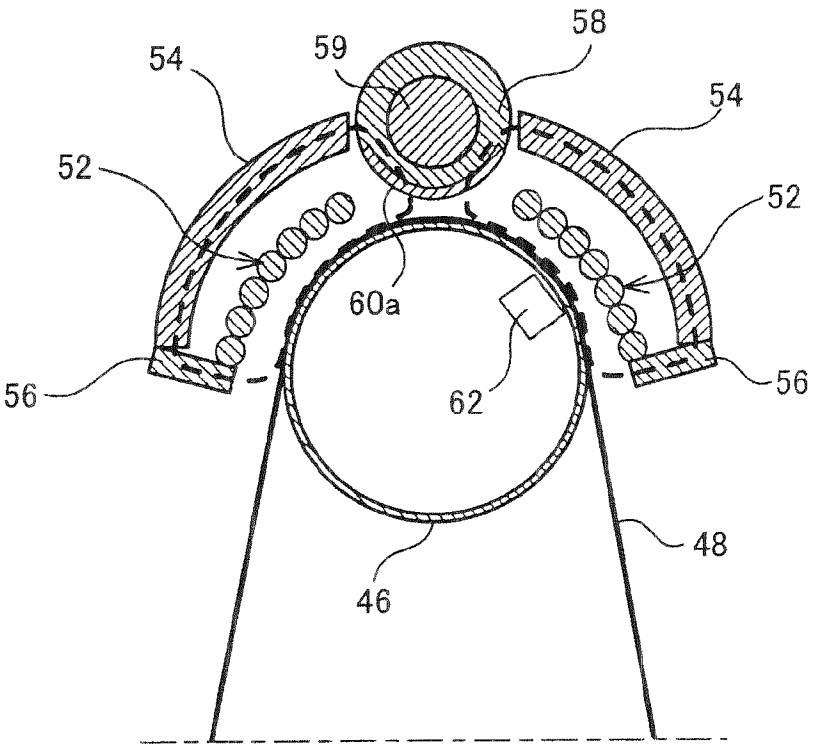
FIGS. 5A and 5B are longitudinal sectional views showing the center core rotating to thereby switch from a shielding position to a retracted position and each showing the shielding position and the retracted position thereof, respectively.
Figure 5A:
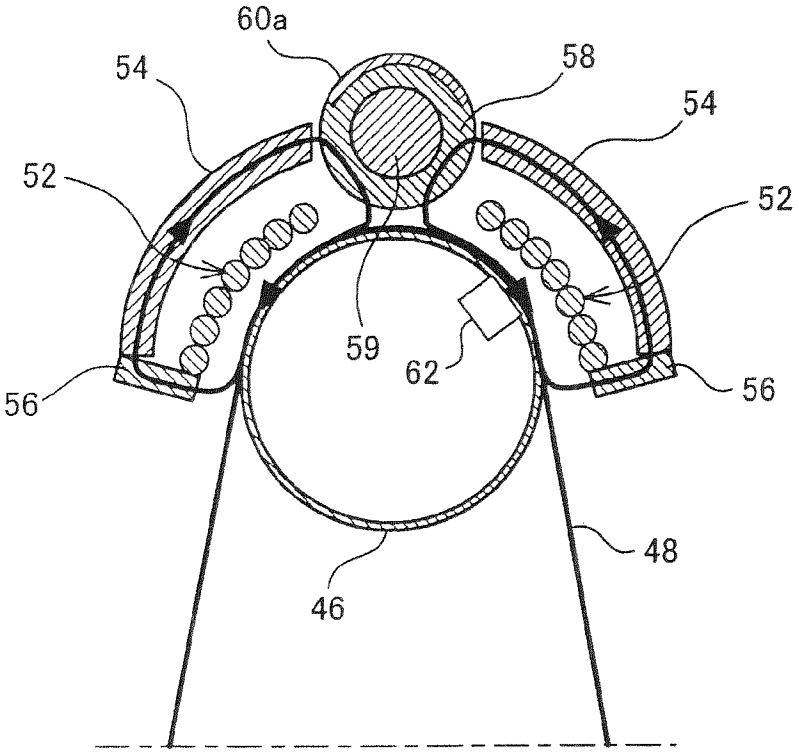

FIGS. 5A and 5B are longitudinal sectional views showing the center core 58 rotating to thereby switch from a shielding position to a retracted position. In FIGS. 5A and 5B, the first shielding member 60*a* is illustrated, but the same is applied to the second and third shielding members 60*b* and 60*c* as well.

[Retracted Position]

FIG. 5A shows an operation in the case where the first shielding member 60*a* at either end is switched to the retracted position as the center core 58 rotates. In this case, a magnetic field generated by the induction heating coil 52 passes the heating belt 48 and the heat roller 46 through the side cores 56, the arch cores 54 and the center core 58. At this time, the ferromagnetic heating belt 48 and heat roller 46 cause an eddy current and generate Joule heat based on the specific resistance of each material, thereby conducting heating.

[Shielding Position]

FIG. 5B shows an operation in the case where the first shielding member 60*a* is switched to the shielding position. In this case, the first shielding member 60*a* is located on the magnetic path at either end (outside of the sheet-conveyed region) of the center core 58, thereby partly suppressing generation of a magnetic field there. This suppresses the quantity of heat generated in the non-sheet-conveyed region, thereby preventing the heating belt 48 or the heat roller 46 from raising the temperature therein excessively.

[Angle to Reference Line]

Figure 6A:
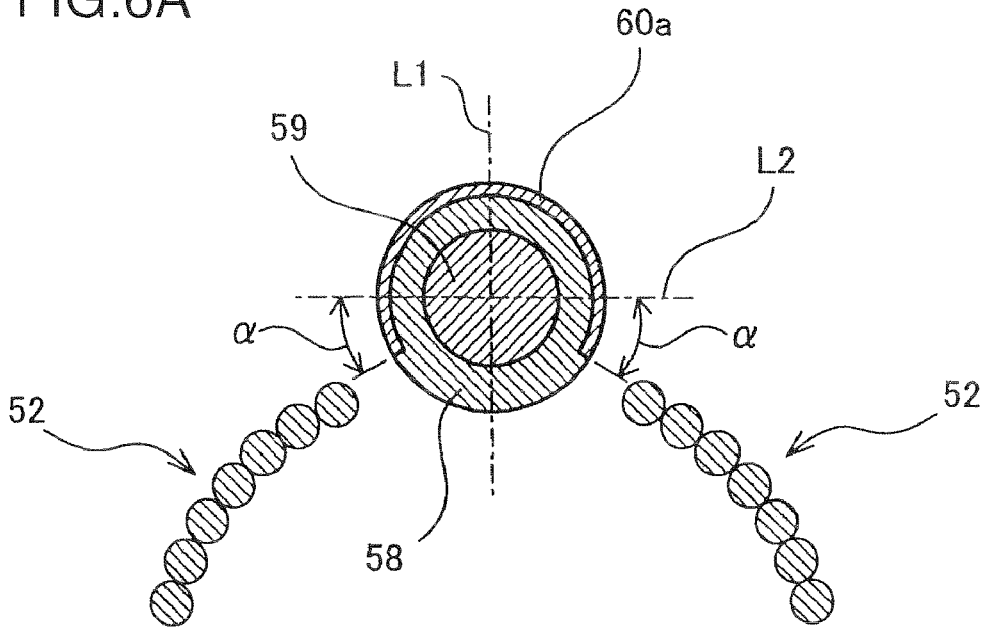
FIG. 6A is a sectional view showing an example of how to set the angle of each shielding member to a reference line in the retracted position.
Figure 6B:
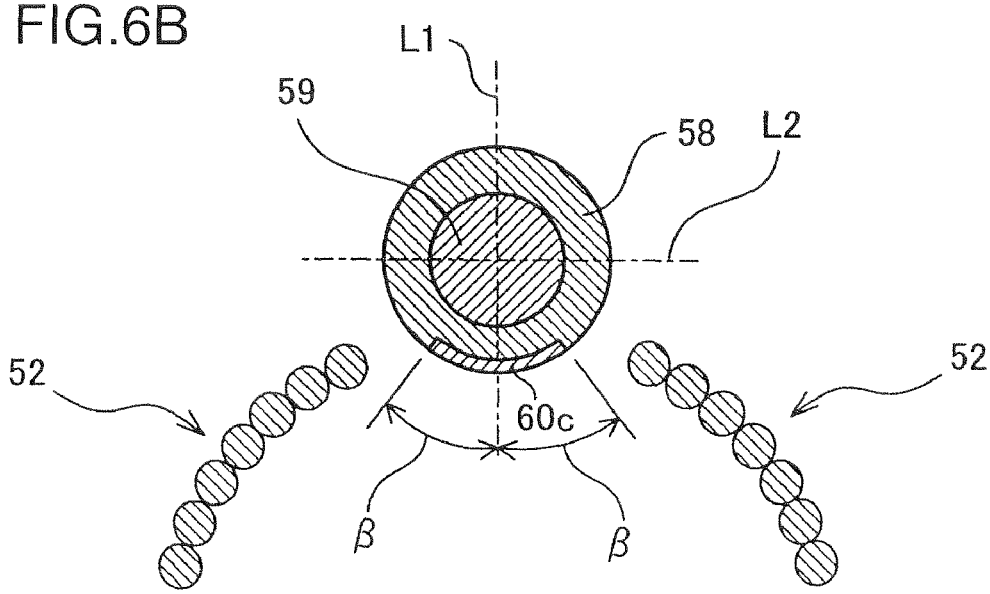
FIG. 6B is a sectional view showing an example of how to set the angle of each shielding member to the reference line in the shielding position.

FIGS. 6A and 6B are sectional views showing an example of how to set the angles of the shielding members 60*a* and 60*c* to a reference line in the retracted position and the shielding position, respectively.

[Angle in Retracted Position]

As shown in FIG. 6A, in the longitudinal cross section of the IH coil unit 50 (similar to the cross section of FIG. 2, a virtual first reference line L1 is the line passing the winding center C of the induction heating coil 52 and a second reference line L2 is the virtual horizontal line perpendicular to the first reference line L1 and passing the center of the center core 58. As the angle around the center of the center core 58, the retracted position is a range of 180 degrees opposite to (herein, above) the induction heating coil 52 with respect to the second reference line L2 and the shielding position is a range of 180 degrees below this and facing the induction heating coil 52. However, since the first shielding member 60*a* has a circumferential-direction width beyond 180 degrees as the center angle, both ends of the first shielding member 60*a* protrudes across the second reference line L2 below (into the shielding position) even when the first shielding member 60*a* is switched to the retracted position. At this time, the protrusion width is set to a center angle α of 50 degrees or below (herein, 30 degrees) on both sides.

In this way, when the longest (widest) first shielding member 60*a* is switched to the retracted position, the protrusion width (center angle α) below the second reference line L2 is 50 degrees or below, thereby evading a magnetism shielding effect in the retracted position.

[Angle in Shielding Position]

In contrast, as shown in FIG. 6B, since the third shielding member 60*c* has a circumferential-direction width of 80 degrees as the center angle, the third shielding member 60*c* shields the center core 58 only within a range less than 180 degrees with switched to the shielding position. At this time, the shielding range is set to a center angle β of 30 degrees or above (herein, 40 degrees) on either side of the first reference line L1. As is not shown in any figure, in the case of the second shielding member 60*b*, the range (center angle β) for shielding the center core 58 in the shielding position is 80 degrees on either side of the first reference line L1.

In this way, the width (center angle β) at the time when the shortest (narrowest) third shielding member 60*c* is switched to the shielding position is set to 30 degrees or above on either side of the first reference line L1, thereby producing an effect great enough to screen out magnetism (cancel a magnetic field) in the shielding position.

[Rotation-Angle Control Method]

Next, a description will be given about a method of controlling the rotation angle of the center core 58 in accordance with the size of a sheet of paper.

FIRST EXAMPLE

FIGS. 7A to 7D show a control method (first example) conceptually when the first to third shielding members 60*a* to 60*c* are arranged in the center core 58 on the above setting condition. In the figures, the abscissa axis indicates the rotation angle of the center core 58 which becomes a reference angle (zero degrees) when all the shielding members 60*a* to 60*c* are switched to the retracted position.

In FIGS. 7A to 7D, the right direction on the abscissa axis indicates an increase in the angle from the reference angle to one direction. The arch cores 54 are each located in the positions of 90 degrees and 270 degrees on the abscissa axis, and when the IH coil unit 50 is in operation, induction heating is conducted within the range of an angle θ (shown by the mesh dots of FIGS. 7A to 7D) around the position of 180 degrees on the abscissa axis.

In the first example of FIGS. 7A to 7D, the rotation angle of the center core 58 is adjusted to each of the reference angle (zero degrees), 90 degrees, 180 degrees and 270 degrees to thereby switch each shielding member 60*a*, 60*b*, 60*c* to the retracted position and the shielding position in accordance with four paper sizes. Individual rotation angles will be below specifically described.

[Reference Angle (0 degrees) Position]

Figures 7A, 7B, 7C, 7D:
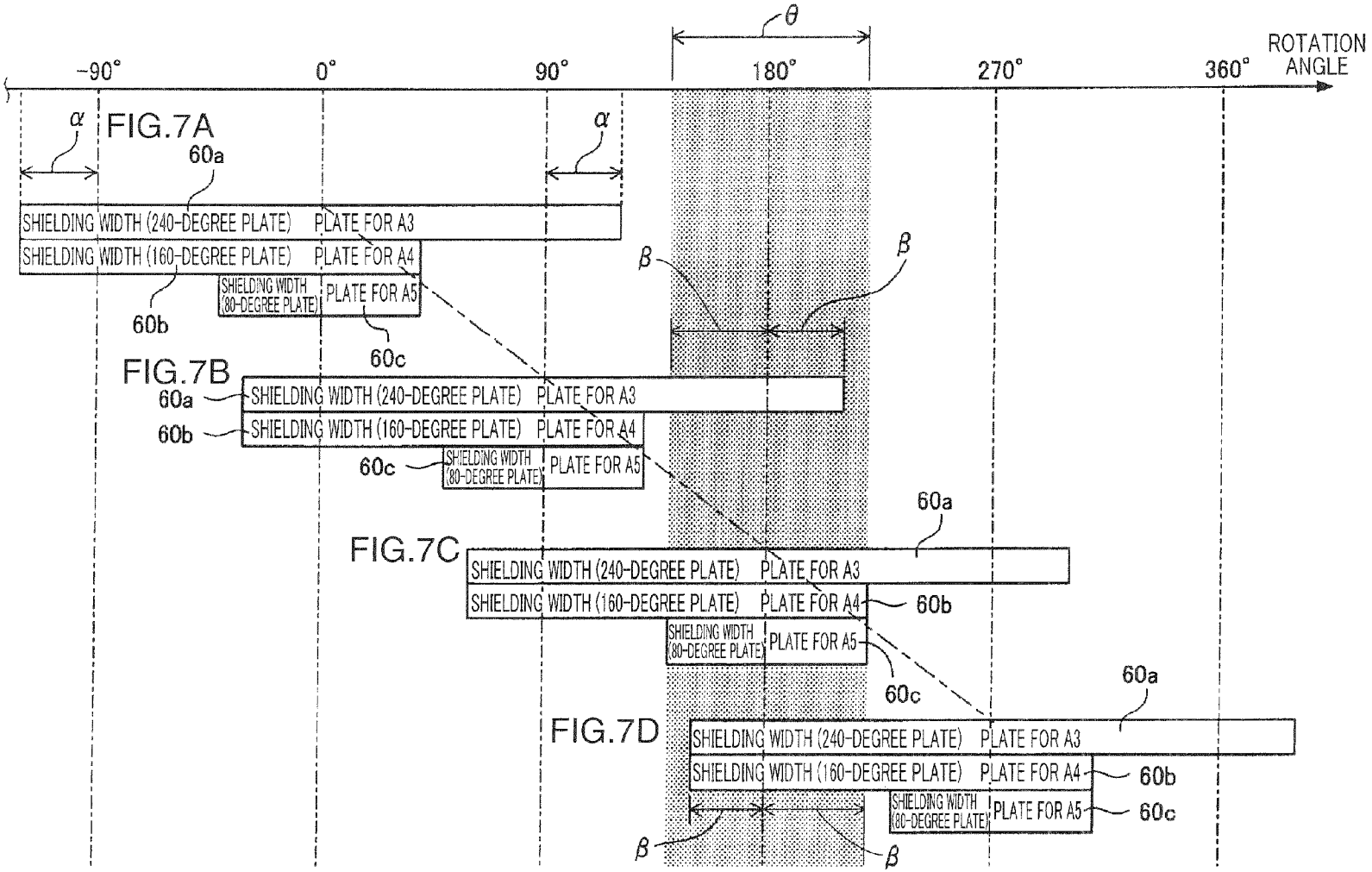
FIGS. 7A to 7D show a control method (first example) conceptually when the first to third shielding members are arranged in the center core.

As shown in FIG. 7A, when the center core 58 is at the reference angle (zero degrees), all the shielding members 60*a* to 60*c* are switched to the retracted position, and in this case, induction heating can be conducted in a sheet-conveyed region W4 corresponding to the maximum paper size (13 inches).

At this time, either of the first shielding member 60*a* and the third shielding member 60*c* lies with the reference angle (zero degrees) located at the middle thereof and extends from there by 120 degrees and 40 degrees, respectively, on both sides in the circumferential directions of the center core 58. On the other hand, the left end of the second shielding member 60*b* on the abscissa axis in the circumferential directions is in the same position as that of the first shielding member 60*a*.

The positions of 90 degrees and −90 degrees on the abscissa axis each correspond to the above second reference line L2, and it can be seen that the protrusion width (center angle α) of the first shielding member 60*a* into the shielding position is 50 degrees or below (herein, 30 degrees).

[90-Degree Position]

FIG. 7B shows the center core 58 rotated by 90 degrees in one direction from the reference angle (zero degrees). In this case, the first shielding member 60*a* is switched to the shielding position and thereby partly enters the heating region (range θ), so that in the position of 90 degrees, induction heating can be conducted in the sheet-conveyed region W3 corresponding to the paper size (A3) one-rank smaller than the maximum.

The positions of zero degrees and 180 degrees on the abscissa axis each correspond to the above first reference line L1, and it can be seen that the range (center angle β) of the center core 58 covered in the heating region by the first shielding member 60*a* is 30 degrees or above (herein, 30 and 40 degrees) on both sides of the first reference line L1. At this time, the protrusion widths (protrusion angles rightward from 90 degrees) of the second shielding member 60*b* and the third shielding member 60*c* into the shielding position are 50 degrees or below (herein, 40 degrees).

[180-Degree Position]

FIG. 7C shows the center core 58 rotated up to the position of 180 degrees from the reference angle (zero degrees). In this case, in addition to the first shielding member 60*a*, the second and third shielding members 60*b* and 60*c* are also switched to the shielding position, and thereby, the first shielding member 60*a* and the second shielding member 60*b* partly and the third shielding member 60*c* wholly enter the heating region (range θ), so that in the position of 180 degrees, induction heating can be conducted in the sheet-conveyed region W1 corresponding to the minimum paper size (A5).

Here in the same way, it can be seen that the ranges (center angles β) of the center core 58 covered in the heating region by the first to third shielding members 60*a* to 60*c* are 30 degrees or above (herein, 40 degrees for all) on both sides of the first reference line L1.

[270-degree Position]

FIG. 7D shows the center core 58 rotated up to the position of 270 degrees from the reference angle (zero degrees). In this case, although the third shielding member 60*c* passes the heating region and is switched to the retracted position, the first shielding member 60*a* and the second shielding member 60*b* are sequentially switched to the shielding position and thereby partly enter the heating region (range θ), so that in the position of 270 degrees, induction heating can be conducted in the sheet-conveyed region W2 corresponding to the intermediate paper size (A4).

At this time, it can be seen that the ranges (center angles β) of the center core 58 covered in the heating region by the first shielding member 60*a* and the second shielding member 60*b* are 30 degrees or above (herein, 30 and 40 degrees) on both sides of the first reference line L1. At this time, the protrusion width (protrusion angle leftward from 270 degrees) of the third shielding member 60*c* into the shielding position is 50 degrees or below (herein, 40 degrees).

SECOND EXAMPLE

Next, FIGS. 8A to 8D show a control method (second example) conceptually when the first to third shielding members 60*a* to 60*c* are arranged differently from the first example. Specifically, in the second example, the first shielding member 60*a* is arranged in such a way that the middle comes to the reference angle (zero degrees) while either of the second shielding member 60*b* and the third shielding member 60*c* is arranged in the circumferential directions in such a way that the left end on the abscissa axis coincides with that of the first shielding member 60*a*.

In the second example alike, the rotation angle of the center core 58 can be adjusted to each of the reference angle (zero degrees), 90 degrees, 180 degrees and 270 degrees to thereby switch each shielding member 60*a*, 60*b*, 60*c* to the retracted position and the shielding position in accordance with four paper sizes. Individual rotation angles will be below specifically described.

[Reference Angle (0 Degrees) Position]

Figures 8A, 8B, 8C, 8D:
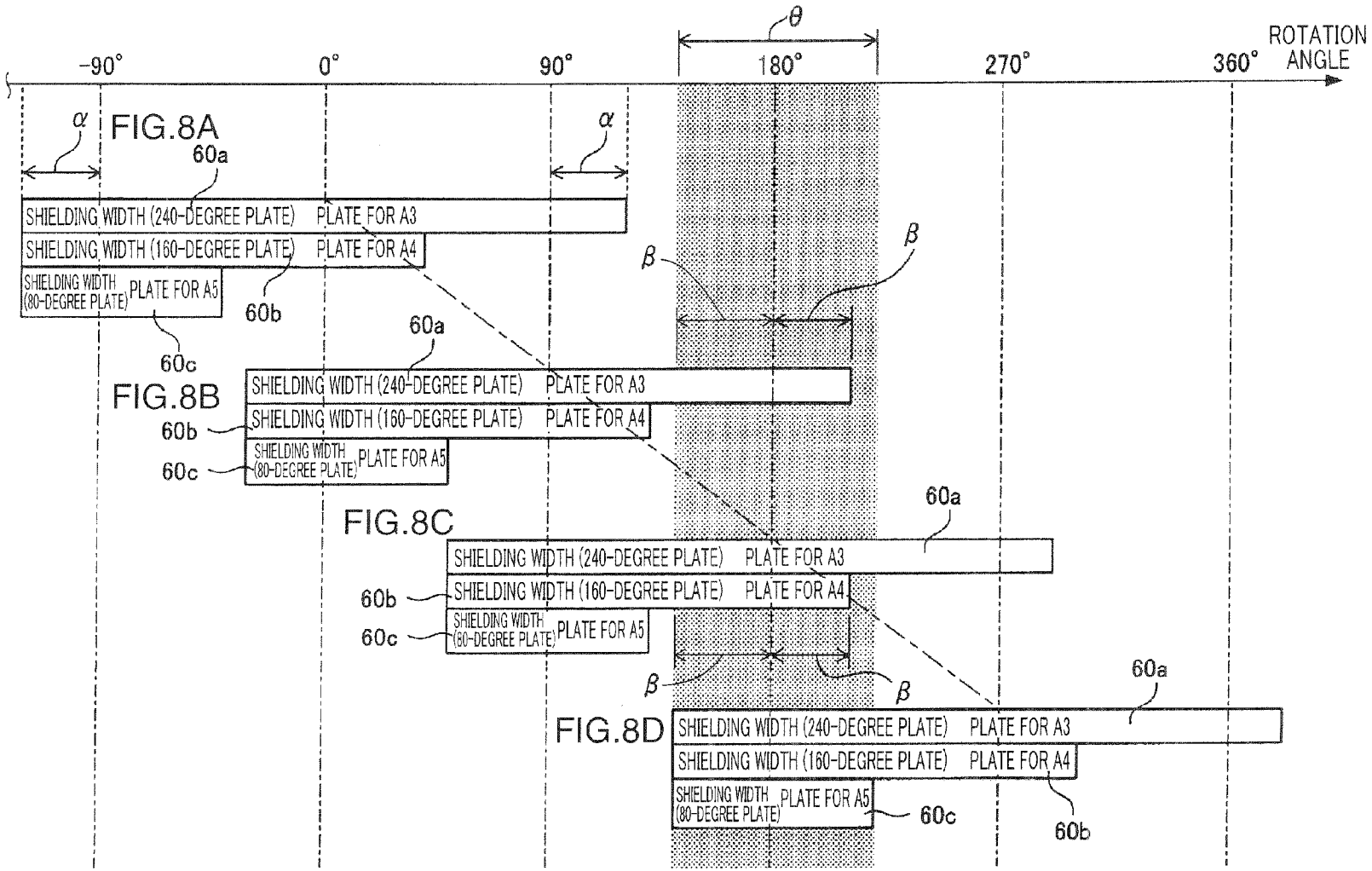
FIGS. 8A to 8D show a control method (second example) conceptually when the first to third shielding members are arranged differently from the first example in the center core.

As shown in FIG. 8A, when the center core 58 is at the reference angle (zero degrees), all the shielding members 60*a* to 60*c* are switched to the retracted position, and in the same way as the first example, induction heating can be conducted in the sheet-conveyed region W4 corresponding to the maximum paper size (13 inches).

At this time, the protrusion width (protrusion angle rightward from 90 degrees) of the first shielding member 60*a* into the shielding position is 50 degrees or below (herein, 30 degrees) and the protrusion widths (protrusion angles leftward from −90 degrees) of the first to third shielding members 60*a* to 60*c* into the shielding position are each 50 degrees or below (herein, 30 degrees for all).

[90-Degree Position]

As shown in FIG. 8B, in the second example, if the center core 58 is rotated by 90 degrees in one direction from the reference angle (zero degrees), the first shielding member 60*a* is switched to the shielding position and thereby partly enters the heating region (range θ), so that in the position of 90 degrees, induction heating can be conducted in the sheet-conveyed region W3 corresponding to the paper size (A3) one-rank smaller than the maximum.

At this time, it can be seen that the range (center angle β) of the center core 58 covered in the heating region by the first shielding member 60*a* is 30 degrees or above (herein, 30 and 40 degrees) on both sides of the first reference line L1. Then, the protrusion width (protrusion angle rightward from 90 degrees) of the second shielding member 60*b* into the shielding position is 50 degrees or below (herein, 40 degrees)

[180-Degree Position]

As shown in FIG. 8C, if the center core 58 is rotated up to the position of 180 degrees from the reference angle (zero degrees), the first shielding member 60*a* and the second shielding member 60*b* are switched to the shielding position and thereby partly enter the heating region (range θ), so that in the position of 180 degrees, induction heating can be conducted in the sheet-conveyed region W2 corresponding to the intermediate paper size (A4).

In addition, it can be seen that the ranges (center angles β) of the center core 58 covered in the heating region by the first and second shielding members 60*a* and 60*b* are 30 degrees or above (herein, 40 and 30 degrees) on both sides of the first reference line L1. At this time, the protrusion width (protrusion angle rightward from 90 degrees) of the third shielding member 60*c* into the shielding position is 50 degrees or below (herein, 40 degrees).

[270-Degree Position]

As shown in FIG. 8D, if the center core 58 is rotated up to the position of 270 degrees from the reference angle (zero degrees), all the shielding members 60*a* to 60*c* are switched to switched to the shielding position, and thereby, the first shielding member 60*a* and the second shielding member 60*b* partly and the third shielding member 60*c* wholly enter the heating region (range θ), so that in the position of 270 degrees, induction heating can be conducted in the sheet-conveyed region W1 corresponding to the minimum paper size (A5).

At this time, it can be seen that the range (center angle β) of the center core 58 covered in the heating region by each of the first to third shielding members 60*a* to 60*c* is 30 degrees or above (herein, 40 degrees for all) on both sides of the first reference line L1.

The above second example has an advantage in that the position of the center core 58 shifts from the reference angle (zero degrees) to 90 degrees, 180 degrees and 270 degrees to thereby make the corresponding paper size smaller one by one, so that the relationship between the paper size and the rotation angle of the center core 58 can be intuitively grasped.

SUMMARY OF FIRST AND SECOND EXAMPLES

In consideration of the above description, the relationship between the width in the circumferential directions of each shielding member 60*a*, 60*b*, 60*c* and the heat-generation capability is substantially as follows.

[In order not to Suppress Heat Generation]

The second and third shielding members 60*b* and 60*c* each have a circumferential-direction width of 180 degrees or below as the center angle and thereby are not supposed to especially suppress heat generation as long as they are on the retracted position side.

On the other hand, the first shielding member 60*a* has a circumferential-direction width of 180 degrees or above as the center angle and thereby extends continuously on both sides of the retracted position and the shielding position. However, the first shielding member 60*a* is not supposed to deteriorate the heat-generation capability especially significantly unless it does not protrude exceeding 50 degrees across the second reference line L2 onto the shielding-position side.

[In order to Suppress Heat Generation]

For example, the circumferential-direction width of the shielding member on the shielding-position side becomes smaller than 70 degrees as the center angle to thereby deteriorate the magnetism shielding capability even though the shielding member is brought to the middle position (180 degrees). Particularly, in order to handle four types of sheets of paper having different sizes, as shown in FIG. 7 (first example), the arrangement and rotation angle of each shielding member 60*a*, 60*b*, 60*c* are controlled. Further, as shown in FIG. 8 (second example), each shielding member 60*a*, 60*b*, 60*c* may be arranged stepwise by truing up the left ends thereof on the abscissa axis. The arrangement and rotation angle in the second example are controlled, thereby particularly at the time of the minimum paper size, keeping the shielding members 60*a*, 60*b* and 60*c* as a whole in balance around the position of 180 degrees (first reference line L1) to realize an optimal shielding capability.

At first, the inventor(s) of the present invention was (were) anxious that if the width in the circumferential direction of a shielding member is set to 180 degrees or above, then even in the reference position (zero degrees) on the retracted position side, a part of the shielding member protrudes onto the shielding-position side to thereby affect the heat-generation capability. However, the inventor(s) repeated experiments eagerly and found out that a shielding member (e.g., the first shielding member 60*a*) having a circumferential-direction width of 180 degrees or above would not produce much effect on the heat-generation capability, as long as the protrusion width onto the shielding-position side is 50 degrees or below.

The inventor(s) also found out that even if the circumferential-direction width of a shielding member is reduced to 180 degrees or below, the shielding capability in the shielding position does not deteriorate so much up to approximately 70 degrees. Therefore, the first and second examples are capable of handling four types of sheets of paper in total having the maximum paper size (13 inches) and three smaller sizes.

THIRD EXAMPLE

Figures 9A, 9B, 9C:
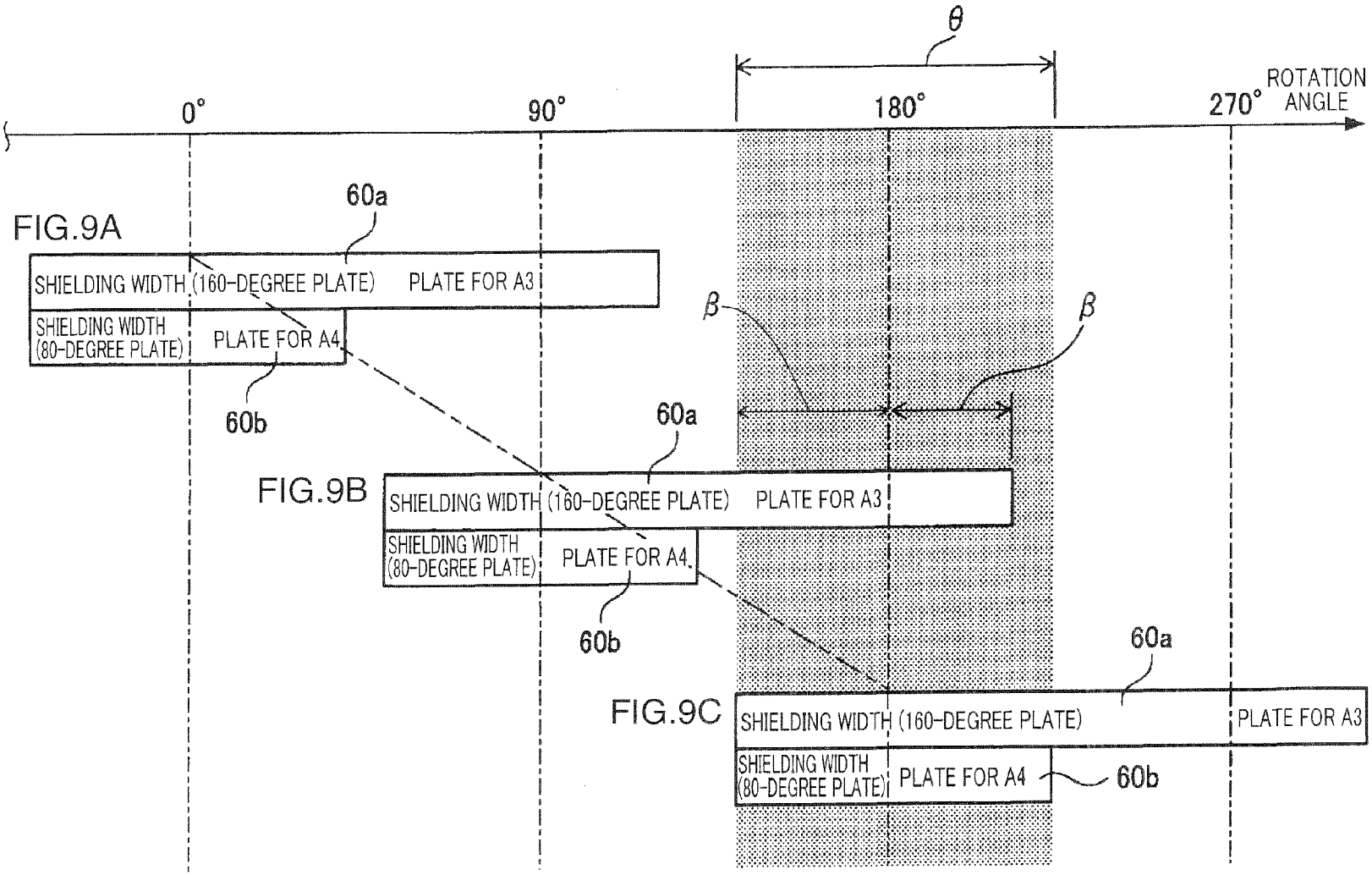
FIGS. 9A to 9C show a control method (third example) conceptually when only the first and second shielding members are arranged in the center core.

Next, FIGS. 9A to 9C show a control method (third example) conceptually when only the first shielding member 60*a* and the second shielding member 60*b* are arranged. In the third example, the length in the circumferential direction of the first shielding member 60*a* is only 160 degrees as the center angle and the length in the circumferential direction of the second shielding member 60*b* is only 80 degrees as the center angle. The second shielding member 60*b* is arranged in the circumferential directions in such a way that the middle comes to the reference angle (zero degrees) and the first shielding member 60*a* is arranged in the circumferential directions in such a way that the left end on the abscissa axis coincides with that of the second shielding member 60*b*.

In the third example, the rotation angle of the center core 58 can be adjusted to three steps—the reference angle (zero degrees), 90 degrees and 180 degrees—to thereby switch each shielding member 60*a*, 60*b* to the retracted position and the shielding position in accordance with three paper sizes (minimum size is A4). Individual rotation angles will be below specifically described.

[Reference Angle (0 Degrees) Position]

As shown in FIG. 9A, when the center core 58 is at the reference angle (zero degrees), both shielding members 60*a* and 60*b* are switched to the retracted position, and in the same way as the first example, induction heating can be conducted in the sheet-conveyed region W4 corresponding to the maximum paper size (13 inches).

At this time, the protrusion width (protrusion angle rightward from 90 degrees) of the first shielding member 60*a* into the shielding position is 50 degrees or below (herein, 30 degrees).

[90-degree Position]

As shown in FIG. 9B, in the third example, if the center core 58 is rotated by 90 degrees in one direction from the reference angle (zero degrees), the first shielding member 60*a* is switched to the shielding position and thereby partly enters the heating region (range θ), so that in the position of 90 degrees, induction heating can be conducted in the sheet-conveyed region W3 corresponding to the paper size (A3) one-rank smaller than the maximum.

At this time, it can be seen that the range of the center core 58 covered in the heating region by the first shielding member 60*a* is 30 degrees or above (herein, 30 and 40 degrees) on both sides of the first reference line L1. Then, the protrusion width (protrusion angle rightward from 90 degrees) of the second shielding member 60*b* into the shielding position is 50 degrees or below (herein, 40 degrees).

[180-degree Position]

As shown in FIG. 9C, if the center core 58 is rotated up to the position of 180 degrees from the reference angle (zero degrees), the first shielding member 60*a* and the second shielding member 60*b* are switched to the shielding position, and thereby, the first shielding member 60*a* partly and the second shielding member 60*b* wholly enter the heating region (range θ), so that in the position of 180 degrees, induction heating can be conducted in the sheet-conveyed region W2 corresponding to the minimum paper size (A4). The third example is incapable of handling any sheets of paper having sizes smaller than this.

In addition, it can be seen that the ranges (center angles β) of the center core 58 covered in the heating region by the first and second shielding members 60*a* and 60*b* are 30 degrees or above (herein, 40 degrees for all) on both sides of the first reference line L1.

As shown in the third example, when three types of sheets having different sizes in total are handled, the rotation-angle control range becomes 180 degrees or below (270 degrees omitted). This makes it possible to more freely determine the attachment position of a member (index 72) for detecting the center core 58 rotated to a certain position.

[Handling More Types of Sheets]

In this embodiment, shielding members are arranged in the center core 58 to handle sheets of paper having different sizes, and thereby, the upper limit is ideally four sizes or so. In order to handle more types of sheets, for example, the shielding members need to be narrowed or the rotation angle controlled with shorter steps. In those cases, however, it is hard to conduct satisfactory setting in the respect of the heat-generation capability in a sheet-conveyed region or the shielding (heat-generation suppression) capability in a non-sheet-conveyed region for each sheet of paper.

There is another means for handling, for example, a B4-size sheet having an intermediate size between A4 length and A3. In this case, control is executed by switching in time series between the rotation angle corresponding to A4 length and the rotation angle corresponding to A3 (reciprocating and rotating the center core 58 with shorter steps in fixing an image), thereby handling the B4-size sheet to a certain extent. Alternatively, when shielding members are arranged stepwise, control is executed to become an intermediate rotation angle between each rotation angle of A4 length and A3, thereby enhancing the magnetism shielding capability and handling the intermediate-size sheet to a certain extent.

[Other Structure Examples of Fixing Unit]

Figure 10:
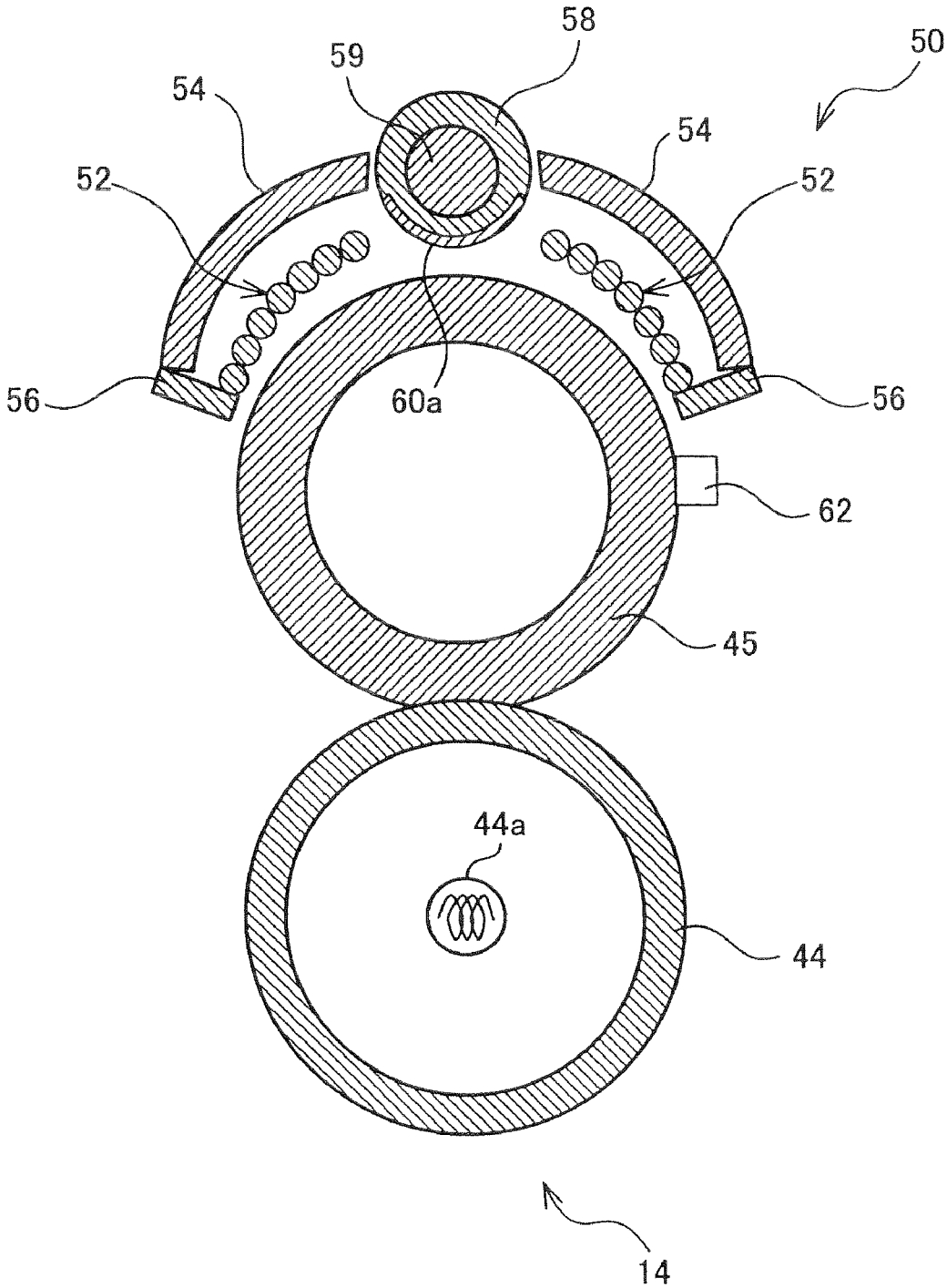
FIG. 10 is a longitudinal sectional view showing another structure example of the fixing unit.

Next, FIG. 10 shows another structure example of the fixing unit 14 which fixes a toner image using the fixing roller 45 and the pressing roller 44 without the above heating belt. For example, a magnetic body similar to the above heating belt is wound onto the periphery of the fixing roller 45 and subjected to induction heating by the induction heating coil 52. In this case, the thermistor 62 is arranged outside of the fixing roller 45 so as to face the magnetic-body layer, but otherwise this structure example has the same as the above and is capable of managing changes in the size of paper by rotating the center core 58.

Figure 11:
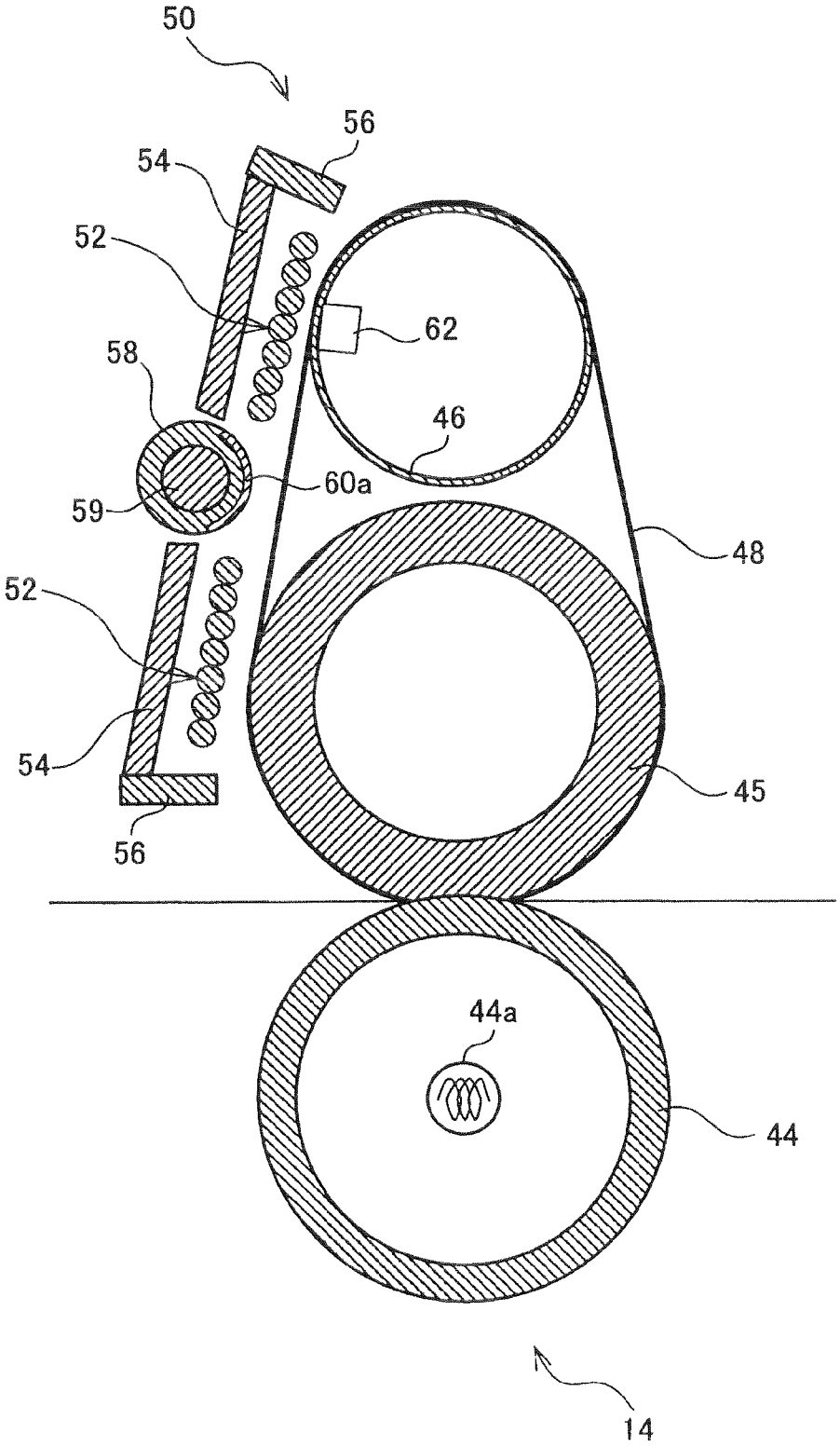
FIG. 11 is a longitudinal sectional view showing another structure example of an IH coil unit.

Further, FIG. 11 shows another structure example of the IH coil unit 50 which conducts induction heating not in an arc-shaped position of the heating belt 48 but in a plane position between the heat roller 46 and the fixing roller 45. This structure example is also capable of managing changes in the size of paper by rotating the center core 58.

The present invention is not restricted to the above embodiments and diverse variations can be implemented. For example, the specific forms of each component element including the arch core 54 or the side cores 56 are not limited to the ones shown in the figures, and hence, can be suitably varied.

The image forming apparatus according to the embodiments described so far mainly have the following configuration.

The image forming apparatus preferably includes an image forming section forming a toner image and transferring the toner image onto a sheet and a fixing unit including a heating member and a pressing member, and fixing the toner image onto the sheet while nipping and conveying the sheet between the heating member and the pressing member. The heating member has a sheet-conveyed region that the sheet passes. The fixing unit further includes a coil arranged along an outer surface of the heating member and generating a magnetic field, a fixed core arranged opposite to the heating member with respect to the coil and forming a magnetic path, a cylindrical movable core so arranged between the fixed core and the heating member with respect to a direction in which the coil generates the magnetic field, as to form the magnetic path together with the fixed core, the cylindrical movable core having an axis extending in a width direction of the sheet being conveyed, a shielding member arranged on an outer peripheral surface of the movable core and shielding the magnetism in the magnetic path, and a magnetism adjusting unit rotating the movable core about the axis to switch the position of the shielding member between a shielding position where the shielding member is positioned inside the sheet-conveyed region to shield the pass of the magnetism and a retracted position where the shielding member is positioned outside the sheet-conveyed region to permit the pass of the magnetism. The shielding member is provided in a plural number in the axial direction of the movable core, the shielding members having a different length in the axial direction and a different width in a circumferential direction of the movable core, the length and the width corresponding to a plurality of sizes of the sheet in the width direction of the sheet. The magnetism adjusting unit switches each of the shielding members between the shielding position and the retracted position in accordance with the width-direction size of the sheet.

Particularly, the shielding member is divided into several parts in the directions of the axis of the movable core and each have a different length in the axis directions and a different width in the circumferential directions of the movable core in accordance with a plurality of sizes of sheets of paper to be forwarded in the width directions thereof. Then, the magnetism adjusting unit adjusts the rotation angle of the movable core in accordance with the size of each forwarded sheet and thereby switches the shielding members outside of the sheet-conveyed region to the shielding position and the shielding members inside of the sheet-conveyed region to the retracted position.

According to this configuration, the plurality of shielding members can be switched to the retracted position inside of the sheet-conveyed region and to the shielding position outside of the sheet-conveyed region in accordance with the rotation angle of the movable core, thereby handling several types of sheets of paper having different sizes in accordance with a preset arrangement pattern of the shielding members for the movable core.

In the above configuration, the circumferential-direction width of the shielding member is set within the range of 70 to 280 degrees around the axis.

Specifically, if the shielding member has a circumferential-direction width of 280 degrees, it includes a part beyond 180 degrees for the movable core. When the thus wide shielding member is switched to the retracted position, the part beyond 180 degrees located on either side in the circumferential directions is kept at 50 degrees. Therefore, even if a fixed core is arranged on either side of the movable core, the shielding member produces little magnetism shielding effect in the retracted position, thereby enabling the heating member to conduct induction heating sufficiently.

On the other hand, if the shielding member has a circumferential-direction width of 70 degrees, the shielding member having this width has a satisfactory magnetism shielding effect when switched to the shielding position. Hence, the shielding member having a width of 70 degrees sufficiently keeps the heating member from excessively raising the temperature outside of the sheet-conveyed region.

In the above configuration, the circumferential-direction width is set to become smaller from the shielding member mounted on an axial end of the movable core to the shielding member mounted on a portion of the movable core axially inward of the axial end.

In the above configuration, the movable core has a cross section perpendicular to the axis and is arranged at a position where a winding center of the coil passes the center of the cross section. When an imaginary line corresponding to the winding center of the coil with respect to the cross section is set as a first reference line and an imaginary line perpendicular to the first reference line and passing the center of the cross section is set as a second reference line, the retracted position of the shielding member is in the range of 180 degrees on the side opposite to the coil with respect to the second reference line in the cross section whereas the shielding position of the shielding member is in the range of 180 degrees on the side facing the coil in the cross section. When the shielding member in a state switched to the retracted position protrudes across the second reference line into the shielding position, the protrusion amount is set within the range of 50 degrees or below around the center of the cross-section on either side of the first reference line. On the other hand, the shielding member in a state switched to the shielding position extends over the range of 30 degrees or above around the center of the cross-section on either side of the first reference line.

It is preferable that the movable core is arranged in such a way that a winding center of the coil passes the center of a cross section perpendicular to the axis thereof; if a first reference line is an imaginary line corresponding to the winding center of the coil in the cross section and a second reference line is an imaginary line perpendicular to the first reference line and passing the center of the cross section, then a range of 180 degrees opposite to the coil with respect to the second reference line in the cross section corresponds to the retracted position of the shielding member and a range of 180 degrees facing the coil other than the above range corresponds to the shielding position of the shielding member; when the shielding member protrudes across the second reference line into the shielding position on the outer peripheral surface of the movable core with switched to the retracted position, the protrusion width is within a range of 50 degrees or below on either side of the first reference line; and when the shielding member covers the outer peripheral surface of the movable core with switched to the shielding position, the cover range is 30 degrees or above on either side of the first reference line.

According to this configuration, the shielding member in the retracted position hardly screens out a magnetic field generated on both sides of the winding center of the coil, thereby exerting the heat-generation capability sufficiently inside of the sheet-conveyed region. On the other hand, when switched to the shielding position, the shielding member sufficiently screens out a magnetism passing the winding center (first reference line) of the coil, thereby exerting the heat-generation capability sufficiently outside of the sheet-conveyed region, thereby certainly preventing the heating member from raising the temperature excessively.

In the above configuration, the magnetism adjusting unit adjusts the rotation angle of the movable core within one rotation of the movable core to any of a predetermined reference angle, a first angle, a second angle and a third angle with respect to the reference angle to switch the shielding member from the retracted position to the shielding position.

This configuration is capable of handling four types of sheets of paper having different sizes at the maximum within one rotation of the movable core.

In the above configuration, the first angle, the second angle and the third angle 50 are 90 degrees, 180 degrees and 270 degrees, respectively, with respect to the reference angle.

This configuration is capable of adjusting the rotation angle more easily by rotating the movable core simply by 90 degrees for each paper size.

In the above configuration, the shielding member includes a first shielding member having a first length and a first circumferential-direction width, a second shielding member having a second length and a second circumferential-direction width smaller than the first length and the first circumferential-direction width and a third shielding member having a third length and a third circumferential-direction width smaller than the second length and the second circumferential-direction width. The first shielding member, the second shielding member and the third shielding member are arranged in order from an axial end of the movable core toward a portion thereof axially inward of the axial end. The magnetism adjusting unit rotates the movable core to any of the reference angle, the first angle, the second angle and the third angle to switch each of the first shielding member, the second shielding member and the third shielding member between the retracted position and the shielding position.

This application is based on Japanese patent application serial No. 2008-187574, filed in Japan Patent Office on Jul. 18, 2008, the contents of which are hereby incorporated by reference.

Although the present invention has been fully described by way of example with reference to the accompanied drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image forming section forming a toner image and transferring the toner image onto a sheet; and a fixing unit including a heating member and a pressing member, and fixing the toner image onto the sheet while nipping and conveying the sheet between the heating member and the pressing member and, wherein:

the heating member has a sheet-conveyed region that the sheet passes;

the fixing unit further includes, a coil arranged along an outer surface of the heating member and generating a magnetic field, a fixed core arranged opposite to the heating member with respect to the coil and forming a magnetic path, a cylindrical movable core so arranged between the fixed core and the heating member with respect to a direction in which the coil generates the magnetic field, as to form the magnetic path together with the fixed core, the cylindrical movable core having an axis extending in a width direction of the sheet being conveyed, a shielding member arranged on an outer peripheral surface of the movable core and shielding the magnetic field, and a magnetism adjusting unit rotating the movable core about the axis to switch the position of the shielding member between a shielding position where the shielding member is positioned inside the sheet-conveyed region to shield the pass of the magnetism and a retracted position where the shielding member is positioned outside the sheet-conveyed region to permit the pass of the magnetism;

the shielding member is provided in a plural number in the axial direction of the movable core, the shielding members having a different length in the axial direction and a different width in a circumferential direction of the movable core, the length and the width corresponding to a plurality of sizes of the sheet in the width direction of the sheet; and the magnetism adjusting unit switches each of the shielding members between the shielding position and the retracted position in accordance with the width-direction size of the sheet.

2. An image forming apparatus, comprising:

an image forming section forming a toner image and transferring the toner image onto a sheet; and a fixing unit including a heating member and a pressing member, and fixing the toner image onto the sheet while nipping and conveying the sheet between the heating member and the pressing member and, wherein:

the heating member has a sheet-conveyed region that the sheet passes;

the fixing unit further includes, a coil arranged along an outer surface of the heating member and generating a magnetic field, a fixed core arranged opposite to the heating member with respect to the coil and forming a magnetic path, a cylindrical movable core so arranged between the fixed core and the heating member with respect to a direction in which the coil generates the magnetic field, as to form the magnetic path together with the fixed core, the cylindrical movable core having an axis extending in a width direction of the sheet being conveyed, a shielding member arranged on an outer peripheral surface of the movable core and shielding the magnetic field, and a magnetism adjusting unit rotating the movable core about the axis to switch the position of the shielding member between a shielding position where the shielding member is positioned inside the sheet-conveyed region to shield the pass of the magnetism and a retracted position where the shielding member is positioned outside the sheet-conveyed region to permit the pass of the magnetism;

the shielding member is provided in a plural number in the axial direction of the movable core, the shielding members having a different length in the axial direction and a different width in a circumferential direction of the movable core, the length and the width corresponding to a plurality of sizes of the sheet in the width direction of the sheet; and the magnetism adjusting unit switches each of the shielding members between the shielding position and the retracted position in accordance with the width-direction size of the sheet, wherein the circumferential-direction width of the shielding member is set within the range of 70 to 280 degrees around the axis.

3. The image forming apparatus according to claim 2, wherein the circumferential-direction width is set to become smaller from the shielding member mounted on an axial end of the movable core to the shielding member mounted on a portion of the movable core axially inward of the axial end.

4. The image forming apparatus according to claim 2, wherein:

the movable core has a cross section perpendicular to the axis and is arranged at a position where a winding center of the coil passes the center of the cross section;

when an imaginary line corresponding to the winding center of the coil with respect to the cross section is set as a first reference line and an imaginary line perpendicular to the first reference line and passing the center of the cross section is set as a second reference line, the retracted position of the shielding member is in the range of 180 degrees on the side opposite to the coil with respect to the second reference line in the cross section whereas the shielding position of the shielding member is in the range of 180 degrees on the side facing the coil in the cross section;

when the shielding member in a state switched to the retracted position protrudes across the second reference line into the shielding position, the protrusion amount is set within the range of 50 degrees or below around the center of the cross-section on either side of the first reference line; and the shielding member in a state switched to the shielding position extends over the range of 30 degrees or above around the center of the cross-section on either side of the first reference line.

5. An image forming apparatus, comprising:

an image forming section forming a toner image and transferring the toner image onto a sheet; and a fixing unit including a heating member and a pressing member, and fixing the toner image onto the sheet while nipping and conveying the sheet between the heating member and the pressing member and, wherein:

the heating member has a sheet-conveyed region that the sheet passes;

the fixing unit further includes, a coil arranged along an outer surface of the heating member and generating a magnetic field, a fixed core arranged opposite to the heating member with respect to the coil and forming a magnetic path, a cylindrical movable core so arranged between the fixed core and the heating member with respect to a direction in which the coil generates the magnetic field, as to form the magnetic path together with the fixed core, the cylindrical movable core having an axis extending in a width direction of the sheet being conveyed, a shielding member arranged on an outer peripheral surface of the movable core and shielding the magnetic field, and a magnetism adjusting unit rotating the movable core about the axis to switch the position of the shielding member between a shielding position where the shielding member is positioned inside the sheet-conveyed region to shield the pass of the magnetism and a retracted position where the shielding member is positioned outside the sheet-conveyed region to permit the pass of the magnetism;

the shielding member is provided in a plural number in the axial direction of the movable core, the shielding members having a different length in the axial direction and a different width in a circumferential direction of the movable core, the length and the width corresponding to a plurality of sizes of the sheet in the width direction of the sheet; and the magnetism adjusting unit switches each of the shielding members between the shielding position and the retracted position in accordance with the width-direction size of the sheet, wherein the magnetism adjusting unit adjusts the rotation angle of the movable core within one rotation of the movable core to any of a predetermined reference angle, a first angle, a second angle and a third angle with respect to the reference angle to switch the shielding member from the retracted position to the shielding position.

6. The image forming apparatus according to claim 5, wherein the first angle, the second angle and the third angle are 90 degrees, 180 degrees and 270 degrees, respectively, with respect to the reference angle.

7. The image forming apparatus according to claim 5, wherein:

the shielding member includes a first shielding member having a first length and a first circumferential-direction width, a second shielding member having a second length and a second circumferential-direction width smaller than the first length and the first circumferential-direction width and a third shielding member having a third length and a third circumferential-direction width smaller than the second length and the second circumferential-direction width;

the first shielding member, the second shielding member and the third shielding member are arranged in order from an axial end of the movable core toward a portion thereof axially inward of the axial end; and the magnetism adjusting unit rotates the movable core to any of the reference angle, the first angle, the second angle and the third angle to switch each of the first shielding member, the second shielding member and the third shielding member between the retracted position and the shielding position.

* * * * *